US011338458B1

(12) United States Patent
Bunch

(10) Patent No.: US 11,338,458 B1
(45) Date of Patent: May 24, 2022

(54) COMBINATION BAGEL SLICER AND SPREADER

(71) Applicant: Ian Bunch, Chadds Ford, PA (US)

(72) Inventor: Ian Bunch, Chadds Ford, PA (US)

( * ) Notice: Subject to any disclaimer, the term of this patent is extended or adjusted under 35 U.S.C. 154(b) by 0 days.

(21) Appl. No.: 16/876,932

(22) Filed: May 18, 2020

(51) Int. Cl.

| | |
|---|---|
| ***B26B 11/00*** | (2006.01) |
| ***B26B 29/00*** | (2006.01) |
| ***A47G 21/00*** | (2006.01) |
| ***B26B 29/06*** | (2006.01) |

(52) U.S. Cl.
CPC ..... *B26B 11/006* (2013.01); *A47G 21/005* (2013.01); *B26B 29/063* (2013.01); *B26B 2029/066* (2013.01)

(58) Field of Classification Search
CPC ..... B26B 11/006; B26B 29/063; B26B 2029/066; A47G 21/005
USPC ..... 30/278, 289, 312, 313
See application file for complete search history.

(56) References Cited

U.S. PATENT DOCUMENTS

| | | | | | |
|---|---|---|---|---|---|
| 359,480 | A * | 3/1887 | Weber | | |
| 439,699 | A * | 11/1890 | Stayman | | |
| 901,395 | A * | 10/1908 | Smith | | |
| 1,200,284 | A * | 10/1916 | Wheaton | A21C 11/106 | 30/307 |
| 2,453,220 | A * | 11/1948 | Gustafson | B26B 3/03 | 30/283 |
| 2,539,225 | A * | 1/1951 | Bettencourt | A47G 21/005 | 30/1 |
| 4,213,241 | A * | 7/1980 | Haapala | A21C 15/04 | 30/115 |
| 4,738,028 | A * | 4/1988 | Belokin | B26B 25/005 | 30/319 |
| 5,903,982 | A * | 5/1999 | Gibson | B26B 29/063 | 30/282 |
| 5,983,505 | A * | 11/1999 | Gibson | B26D 3/30 | 30/279.2 |
| D542,609 | S * | 5/2007 | Peterson | D7/694 | |
| 7,458,163 | B2 * | 12/2008 | Teich | A47J 43/288 | 15/236.08 |
| 8,628,266 | B2 * | 1/2014 | Martin, Jr. | B26B 3/00 | 401/261 |
| 8,631,583 | B2 * | 1/2014 | Moss | B26B 5/007 | 30/304 |
| 8,661,693 | B2 * | 3/2014 | Bagley | B26B 25/005 | 30/312 |
| 9,668,487 | B2 * | 6/2017 | Starr | B23D 51/03 | |
| 2011/0283549 | A1 * | 11/2011 | Moss | B26D 3/283 | 30/304 |
| 2016/0021892 | A1 * | 1/2016 | Avila Macias | B26D 3/245 | 30/114 |

* cited by examiner

*Primary Examiner* — Hwei-Siu C Payer
(74) *Attorney, Agent, or Firm* — Joseph E. Maenner; Maenner & Associates, LLC

(57) ABSTRACT

A combination bagel slicer and spreader includes a generally cylindrical upper portion extending along a central axis, an elongate blade extending outwardly from the upper portion and extending along a plane generally parallel to the central axis, and a lower generally cylindrical portion extending below the blade and along the central axis.

9 Claims, 9 Drawing Sheets

COMBINATION BAGEL SLICER AND SPREADER

BACKGROUND OF THE INVENTION

Field of the Invention

The present invention relates to a tool that can be used to both slice a bagel and to also apply a spread to the sliced bagel.

Description of the Related Art

When a person slices a bagel, the person typically uses a sharp, serrated knife to cut through the dense dough of the bagel. Then, to apply a spread, such as butter or cream cheese, to the bagel, the person may use a different knife, such as a butter knife. Additionally, oftentimes, some of the spread inadvertently ends up in the center hole of the bagel, which can result in the spread dropping or dripping out of the bagel and onto the person.

It would be beneficial to provide a single tool that can both slice and apply a spread to a bagel, as well as keep the spread out of the center hole of the bagel.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a combination bagel slicer and spreader. The spreader includes a generally cylindrical upper portion extending along a central axis, an elongate blade extending outwardly from the upper portion and extending along a plane generally parallel to the central axis, and a lower generally cylindrical portion extending below the blade and along the central axis.

In an alternative embodiment, a combination bagel slicer and spreader includes an upper handle having a bagel guide extending outwardly therefrom, a blade extending outwardly from the bagel guide, and a lower handle extending downwardly from the upper handle.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
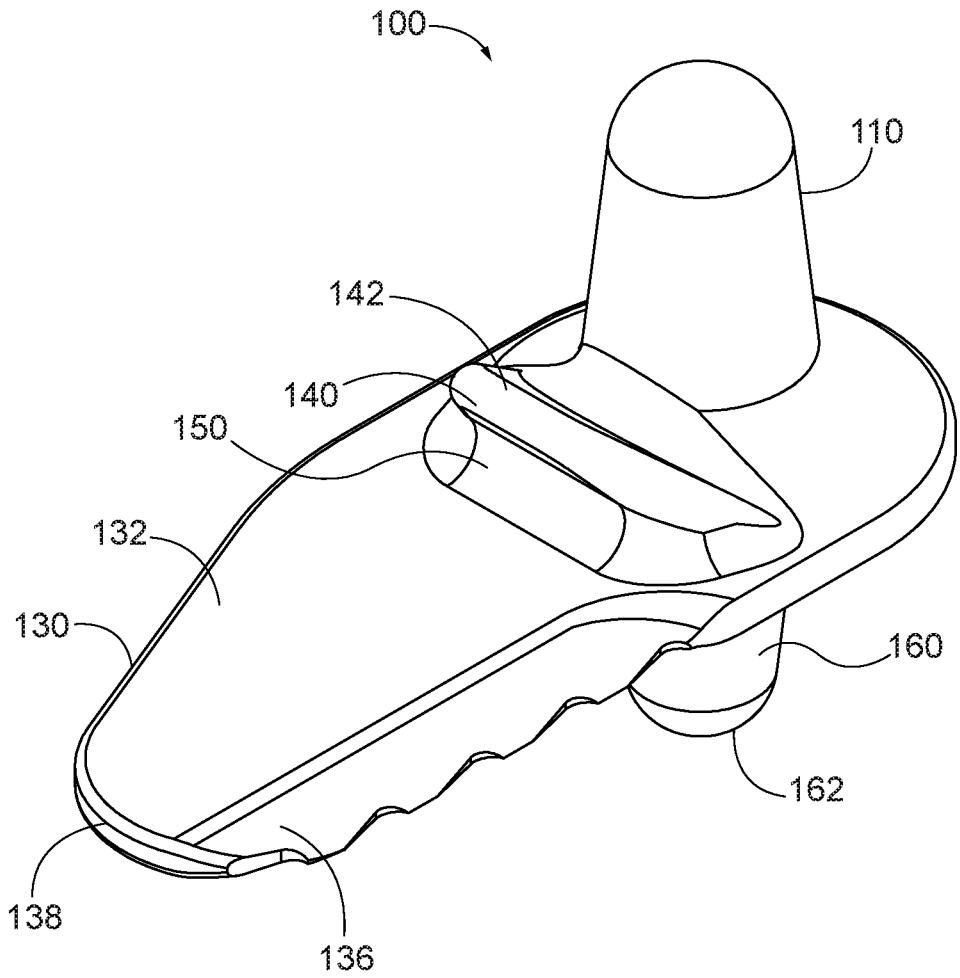
FIG. 1 is a top perspective view of a bagel slicer and spreader according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "proximal" is intended to mean a direction closer to a driver of a tractor utilizing the inventive kit and "distal" is intended to mean a direction farther from the driver.

The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

Figure 2:
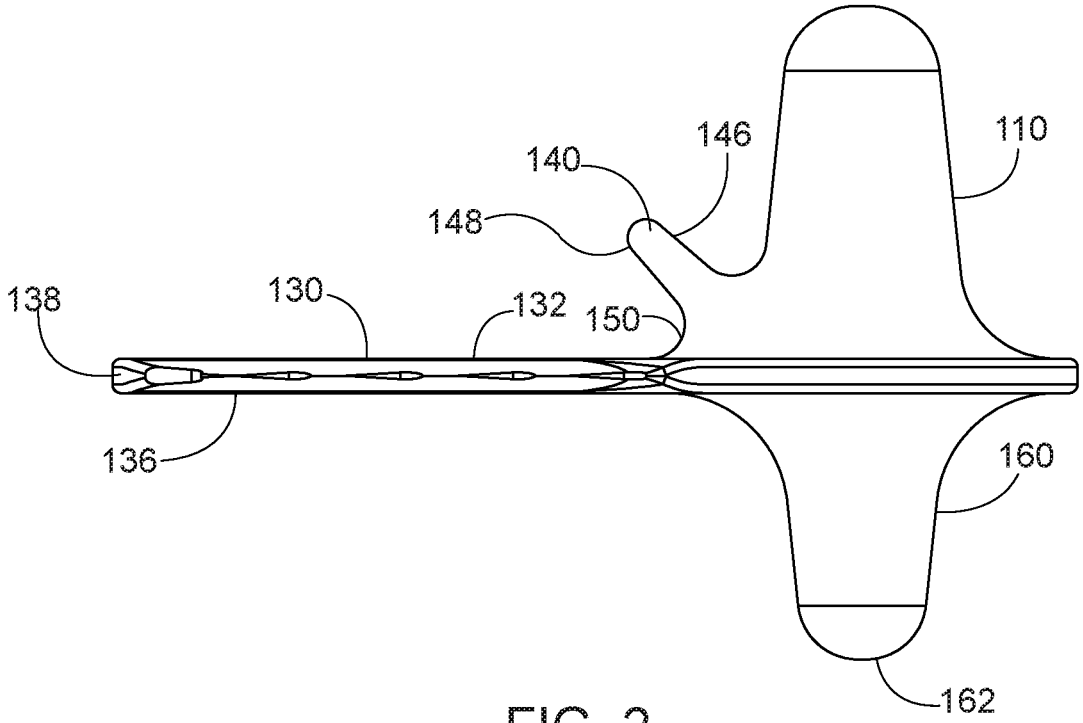
FIG. 2 is a front elevational view of the bagel slicer and spreader of FIG. 1.
Figure 3:
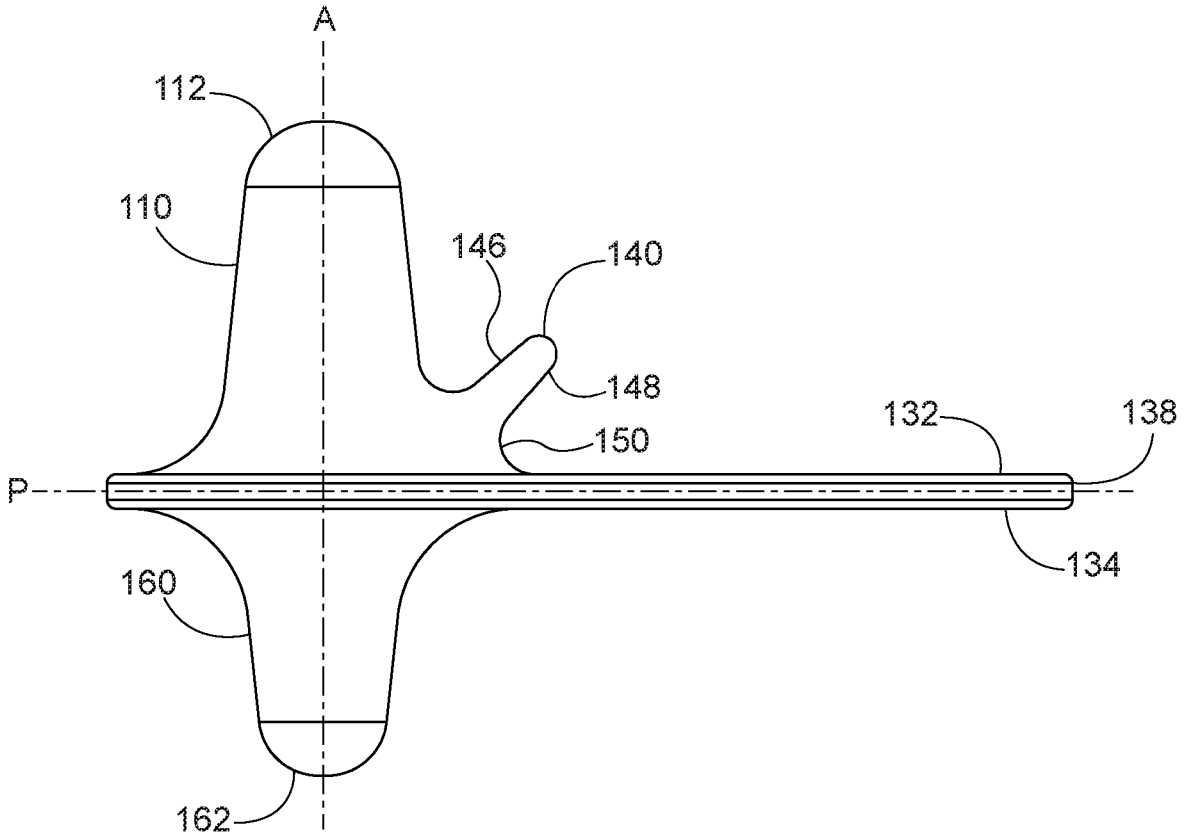
FIG. 3 is a rear elevational view of the bagel slicer and spreader of FIG. 1.

Referring to FIGS. 1-3, a combination bagel slicer and spreader 100 ("spreader 100") according to an exemplary embodiment of the present invention is shown. Spreader 100 can be a unitary single-piece construction molded from a biocompatible polymer. Alternatively, spreader 100 can be constructed from multiple parts and attached together, either permanently or removably.

Spreader 100 includes a generally cylindrical upper handle portion 110 extending along a central axis "A". In an exemplary embodiment, the upper handle portion 110 has a height of about 3¼ inches. A top 112 of upper handle portion 110 can be rounded. A body 114 of upper handle portion 110 can flare outwardly so that a lower part of upper handle portion 110 is wider than a top part of upper handle portion 110.

Figure 4:
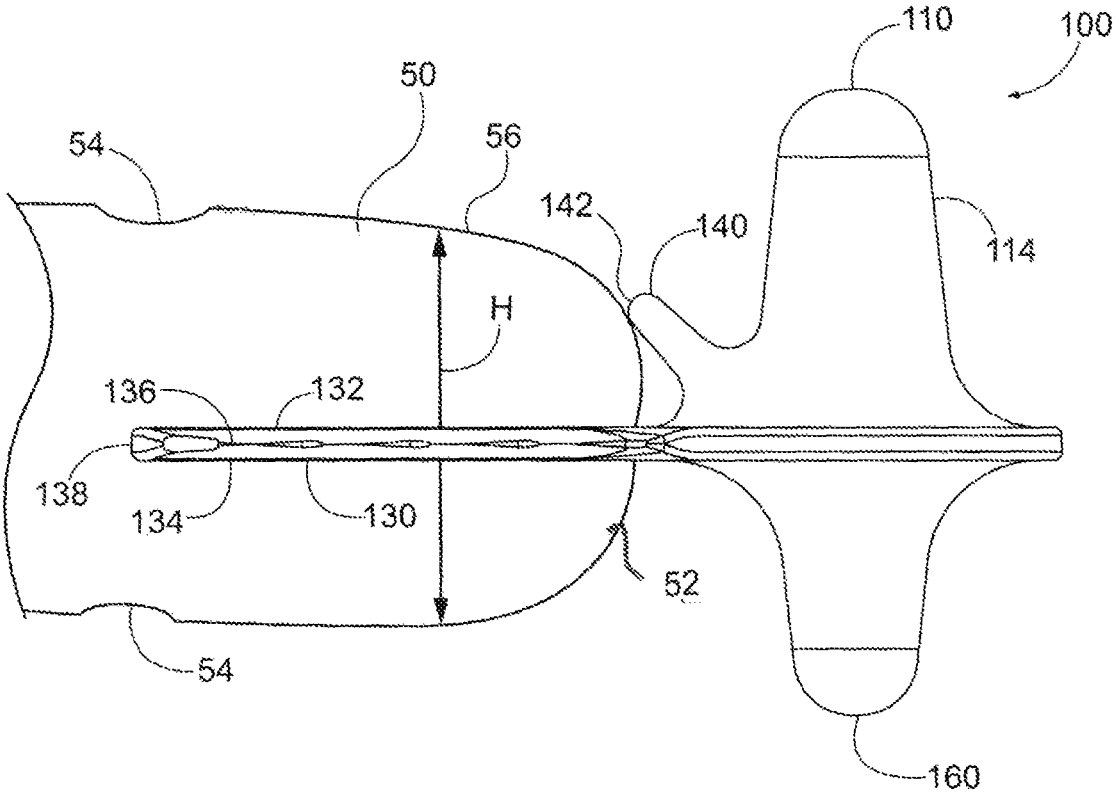
FIG. 4 is a side elevational view of the bagel slicer and spreader of FIG. 1 inserted into a bagel for cutting.

An elongate blade 130 extends outwardly from the upper handle portion 110 and extends along a plane "P" that extends generally perpendicular to the central axis A. Blade 130 has an upper face 132, a lower face 134, and a cutting blade 136 that can extend the length of blade 130 between upper face 132 and lower face 134. Cutting blade 136 can be serrated. A tip 138 of blade 130, distal from upper handle portion 110, can have a rounded profile as shown in FIG. 1, but is sharp enough to be able to insert blade 130 into a bagel 50. As shown in FIG. 4, bagel 50 has a height "H".

In an exemplary embodiment, blade 130 has a length of about 3 inches from upper handle portion 110 to tip 138. This length is greater than the typical length from the side 52 of bagel 50 to the hole 54 in the center of bagel 50 so that when blade 130 is inserted into bagel 50 to cut bagel 50, a user can cut the entire bagel 50 by sawing blade 130 around the perimeter of bagel 50.

A guide 140 extends outwardly from the upper handle portion 110 such that guide 140 engages blade 130 such that blade 130 extends outwardly from guide 140. Guide 140 has a point 142 projecting outwardly from upper handle portion 110. A distance between point 142 and blade 130 is about one half of the height H of bagel 50 so that, when blade 130 is inserted into bagel 50 to slice bagel 50, point 142 is at or toward the top 56 of bagel 50.

Guide 140 also has a proximal face 146, a distal face 148, and an arcuate, concave face 150 extending between distal face 148 and blade 130, with a smooth transition between arcuate, concave face 150 and blade 130.

A lower generally cylindrical portion 160 extends below blade 130 from upper handle portion 110 and along the central axis A. A bottom 162 of lower generally cylindrical portion 160 can be rounded. In an exemplary embodiment, lower generally cylindrical portion 160 has a height of about 1½ inches and is sized to fit inside bagel hole 54.

Figure 5:
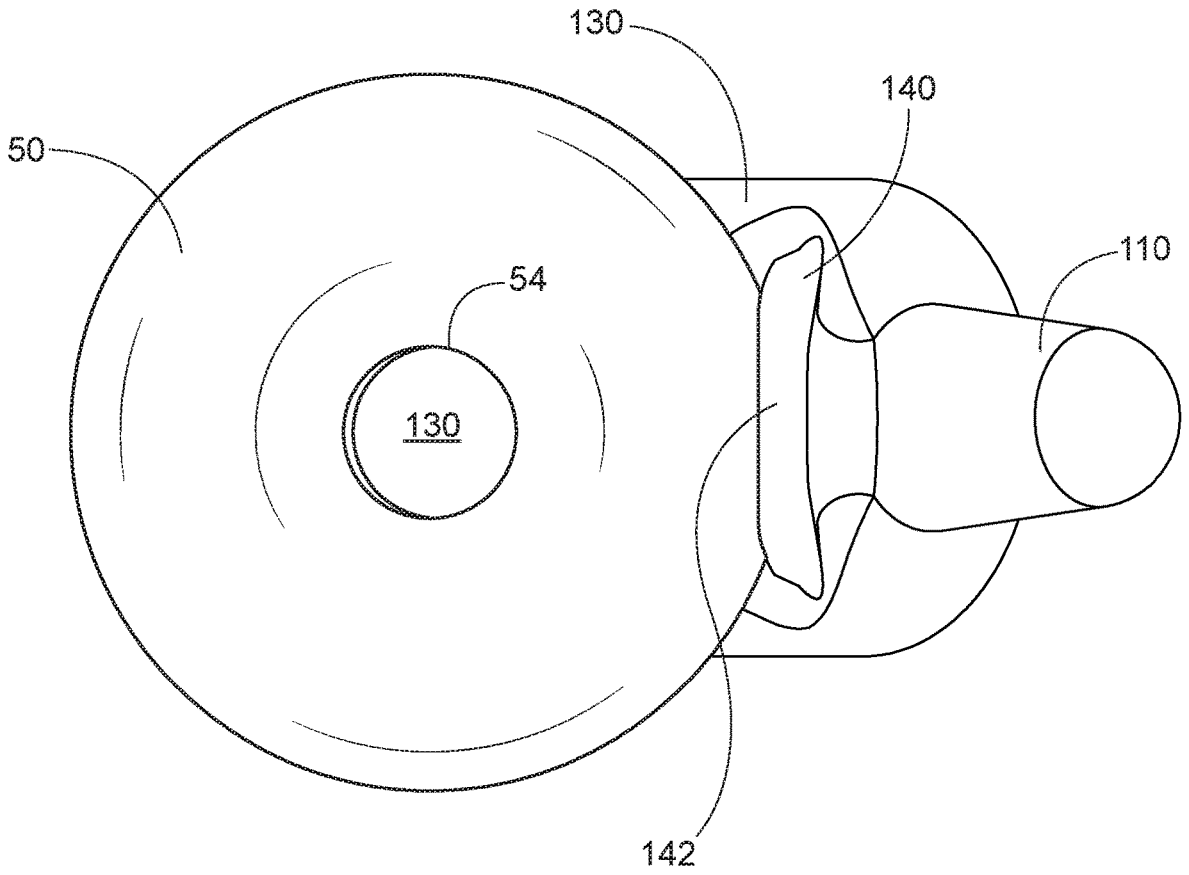
FIG. 5 is a top plan view of the bagel slicer and spreader with the bagel of FIG. 4.

A user can grasp spreader 100 in one hand and hold bagel 50 in the other hand. Referring to FIG. 5, the user can align blade 130 with the side of bagel 50 so that blade 130 can cut through side 52 of bagel 50 and extend into hole 54 so that a full revolution of blade 130 around side 52 of bagel 50 cuts bagel 50 into a top and a bottom piece.

Figure 6:
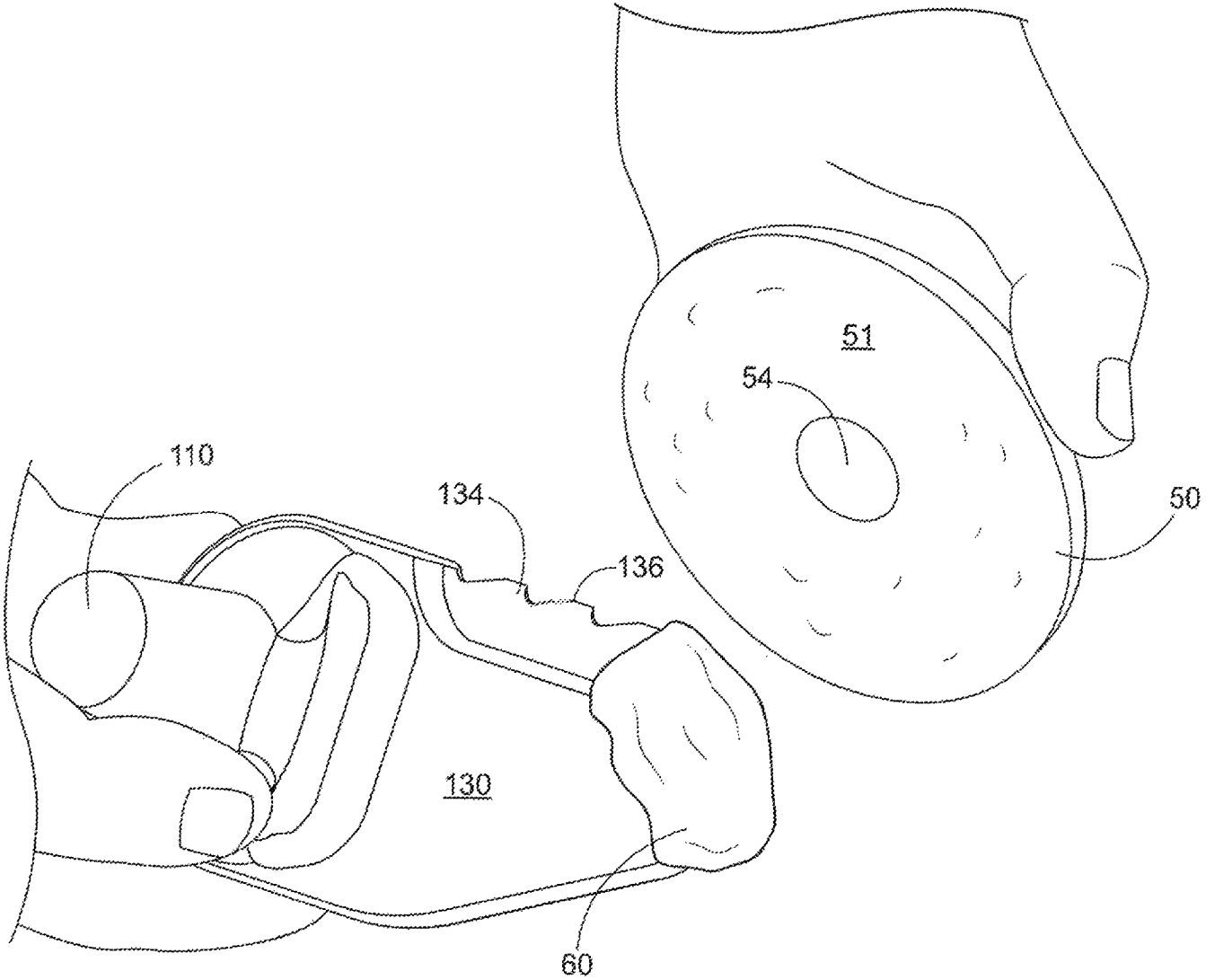
FIG. 6 is a top plan view of a spread applied to the blade of the bagel slicer and spreader of FIG. 1.
Figure 7:
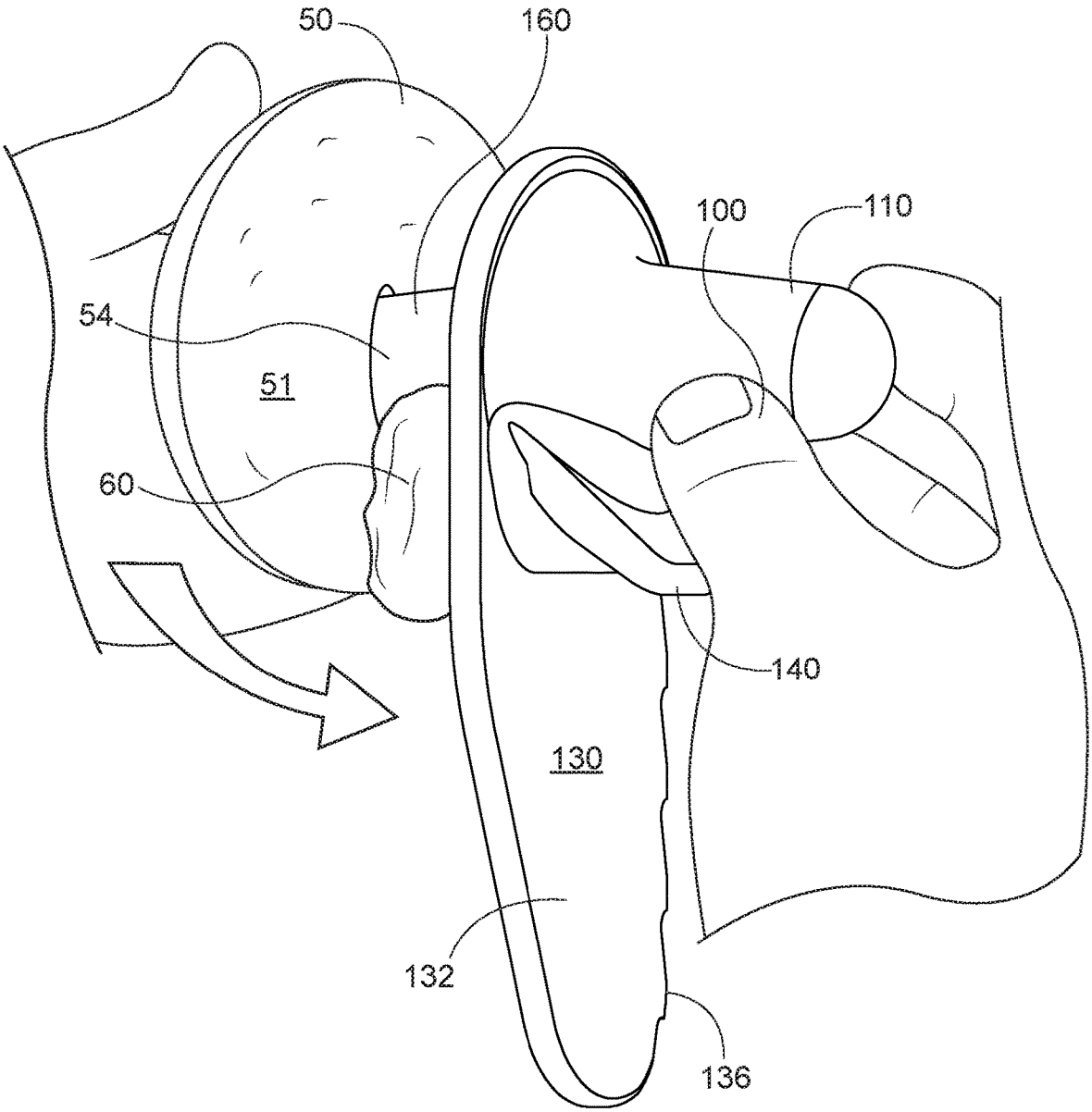
FIG. 7 is a top perspective view of the bagel slicer and spreader of FIG. 1 inserted into a bagel for spreading a spread onto the bagel.
Figure 8:
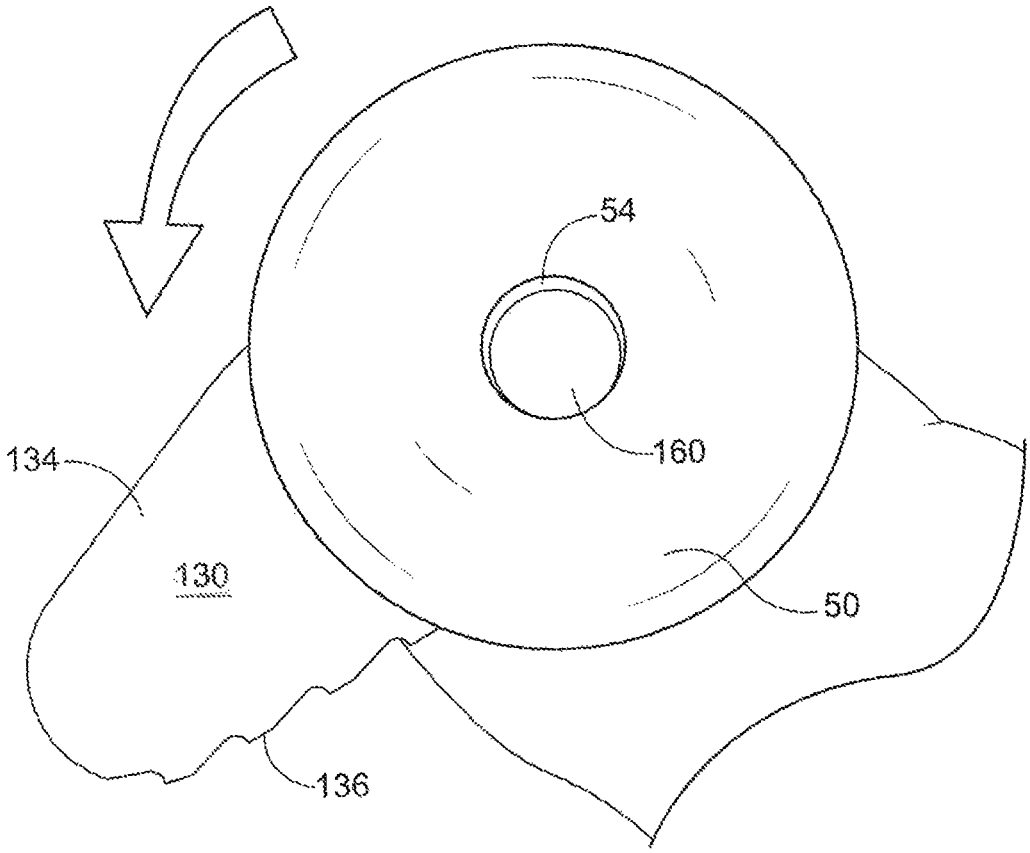
FIG. 8 is a bottom plan view of the bagel slicer and spreader of FIG. 1 inserted into the bagel for spreading the spread onto the bagel.
Figure 9:
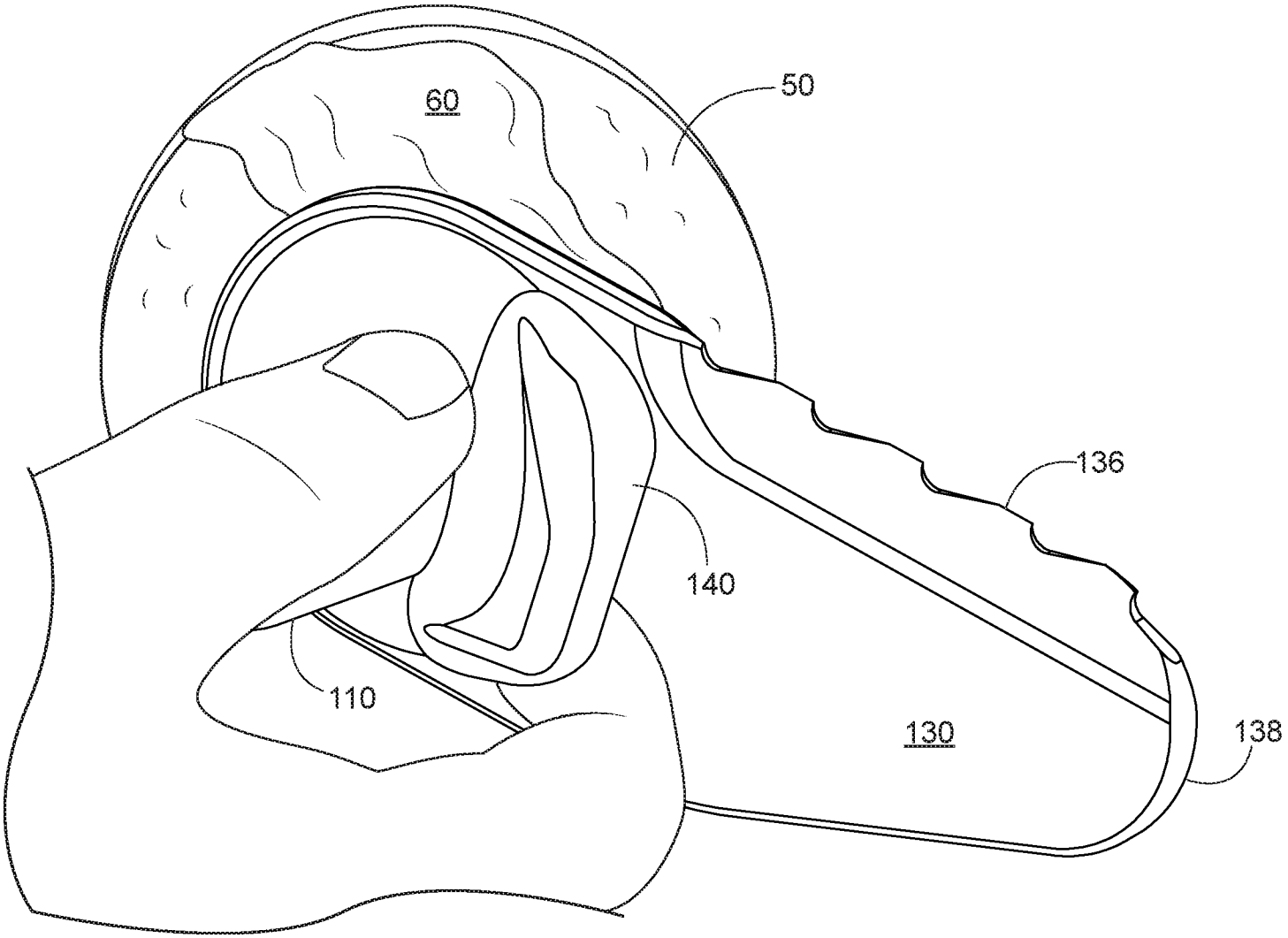
FIG. 9 is a top plan view of the bagel slicer and spreader with bagel of FIG. 8.
Figure 10:
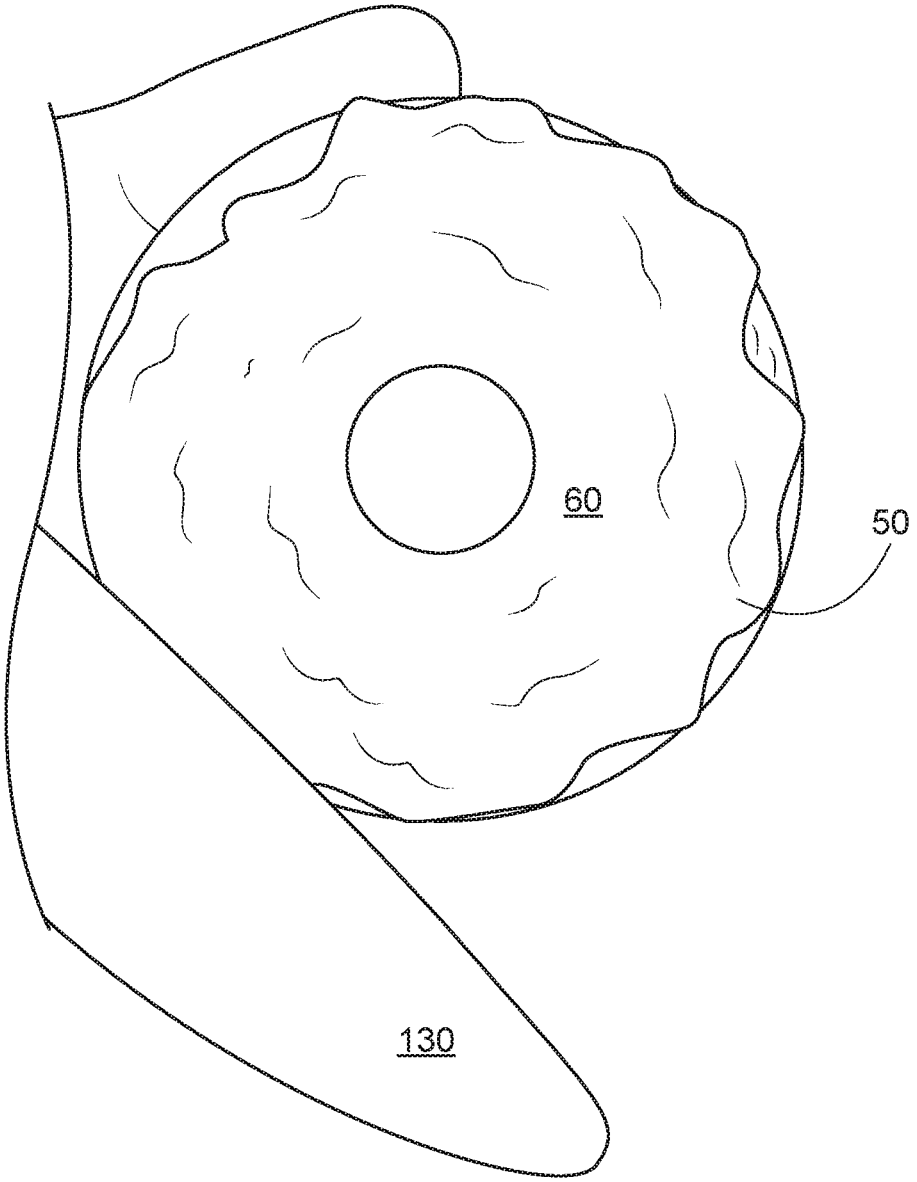
FIG. 10 is a perspective view of the bagel with spread having been spread on the bagel with the bagel slicer and spreader of FIG. 1.

Referring to FIGS. 6-10, spreader 100 is used to spread a spread 60 onto the bottom piece 51 of bagel 50. As shown in FIG. 6, a spread 60 is applied to blade 130. Referring to FIGS. 7-9, lower generally cylindrical portion 160 is inserted into hole 54 and blade 130 is rotated around bagel 50, with lower generally cylindrical portion 160 being maintained in hole 54. As blade 130 rotates, the spread 60 is spread around the top surface of bagel 50, without getting any of the spread 60 into hole 54. As shown in FIG. 10, after the spread 60 is spread around bagel 50, spreader 100 is removed from bagel 50.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A combination bagel slicer and spreader comprising:

a generally cylindrical upper portion extending along a central axis;

an elongate blade extending outwardly from the upper portion and extending along a plane that intersects the central axis at a single point;

a lower generally cylindrical portion extending below the blade and along the central axis;

a guide extending outwardly from the upper portion, the guide engaging the blade; and wherein the guide has a distal face, and an arcuate face extending between the blade and the distal face.

2. The combination bagel slicer and spreader according to claim 1, wherein the guide has a point and a concave surface extending between the point and the blade.

3. The combination bagel slicer and spreader according to claim 1, wherein the upper portion has a height of 3.25 inches.

4. The combination bagel slicer and spreader according to claim 1, wherein the lower portion has a height of 1.5 inches.

5. The combination bagel slicer and spreader according to claim 1, wherein the lower portion is rounded.

6. The combination bagel slicer and spreader according to claim 5, further comprises a smooth transition between the arcuate face and the blade.

7. A combination bagel slicer and spreader comprising:

an upper handle having a bagel guide extending outwardly therefrom, the upper handle extending along a central axis;

a blade extending outwardly from the bagel guide and extending in a plane perpendicular to the central axis; and a lower handle extending downwardly from the upper handle and extending along the central axis, wherein the bagel guide comprises an arcuate face adjacent to the blade.

8. The combination bagel slicer and spreader according to claim 7, wherein the bagel guide has a point projecting outwardly from the upper handle.

9. The combination bagel slicer and spreader according to claim, 8, wherein the arcuate face extends between the point and the blade.

* * * * *